United States Patent [19]

Weber et al.

[11] 4,259,158

[45] Mar. 31, 1981

[54] APPARATUS FOR PRODUCING ABRASION RESISTANT COKE FROM BROWN COAL BRIQUETS

[75] Inventors: Heinrich Weber, Recklinghausen; Kurt Lorenz, Hattingen; Horst Dungs, Herne; Roman Kurtz; Hans-Joachim Kersting, both of Frechen, all of Fed. Rep. of Germany

[73] Assignees: Firma Carl Still GmbH & Co. KG; Rheinische Braunkohlenwerke AG, both of Fed. Rep. of Germany

[21] Appl. No.: 61,917

[22] Filed: Jul. 30, 1979

Related U.S. Application Data

[62] Division of Ser. No. 18,870, Mar. 9, 1979.

[30] Foreign Application Priority Data

Mar. 18, 1978 [DE] Fed. Rep. of Germany ..... 2812005

[51] Int. Cl.[3] ..... C10B 1/04

[52] U.S. Cl. ..... 202/121; 202/117; 201/34; 201/44; 201/6; 201/37; 34/170

[58] Field of Search ..... 202/121, 117, 228; 201/6, 34, 37, 44; 34/226, 228, 231, 167, 168, 171, 170, 178

[56] References Cited

U.S. PATENT DOCUMENTS

| | | | |
|---|---|---|---|
| 3,172,823 | 3/1965 | John et al. | 201/34 |
| 3,300,873 | 1/1967 | Russell et al. | 34/170 |
| 4,115,202 | 9/1978 | Lorenz et al. | 201/34 |
| 4,148,692 | 4/1979 | Chu et al. | 201/34 |

*Primary Examiner*—Norman Yudkoff

*Attorney, Agent, or Firm*—John J. McGlew

[57] ABSTRACT

A method of producing abrasion resistant coke from brown coal briquets in a shaft furnace comprises charging the coke briquets into the top of the furnace and removing coke from the bottom of the furnace while directing inert hot combustion gases into the furnace and through the briquets at a plurality of vertically spaced levels throughout the height of the shaft furnace. Gases are directed at temperatures to effect and successively lower stages of the furnace the preheating, predrying, carbonization, and cooling of the charge. In accordance with a feature of the invention, gases are collected in each of the preheating and predrying stages by the use of a tubular suction arm which extends substantially across the width of the furnace and includes a performated bottom and sidewalls which extend partly below the bottom and are provided with a saw-tooth configuration so as to withdraw the gases through the space below the bottom and through the perforations of the bottom and to effect entrainment of dust from the charge in so doing. The shaft furnace construction for carrying out the method includes means for circulating the hot gases into each of the stages and the closed tubular suction arm which extends substantially across the whole width of the furnace in each of the preheating and predrying stages includes a bottom perforated wall and side walls which extend downwardly beyond the bottom and arranged so as to draw off a percentage of the gases from the associated stage and in so doing prevent the outflow dust along with the gases. The construction is such that about 10% of the gases is evacuated below the perforated bottom and then up through the bottom and withdrawn through the suction arm.

6 Claims, 5 Drawing Figures

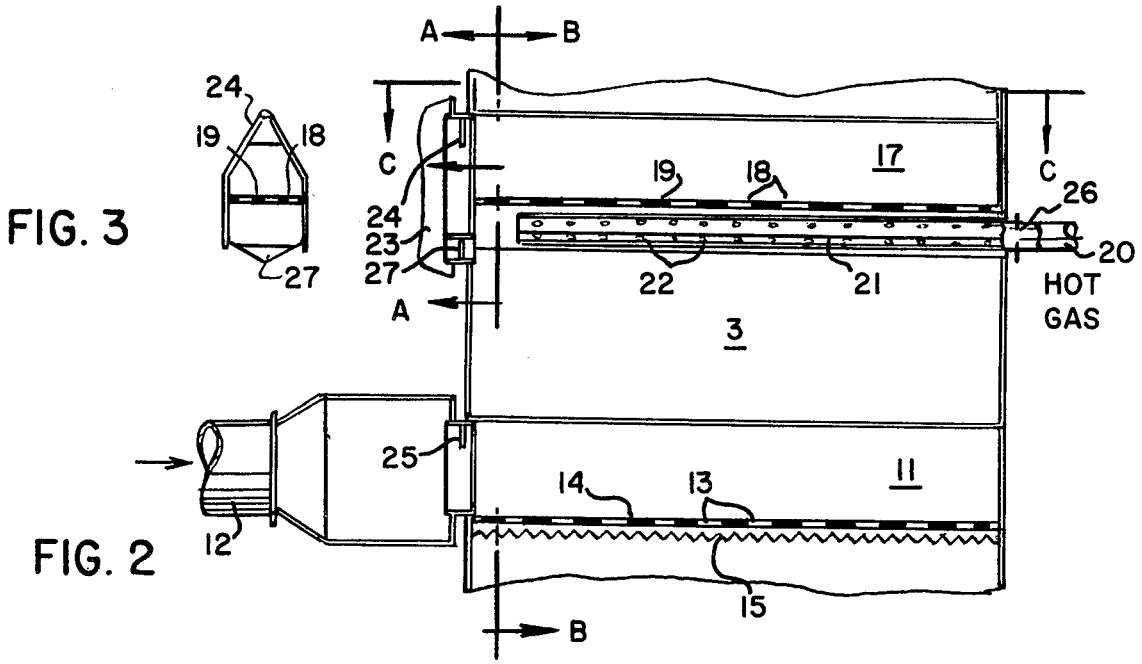
FIG. 3
FIG. 2
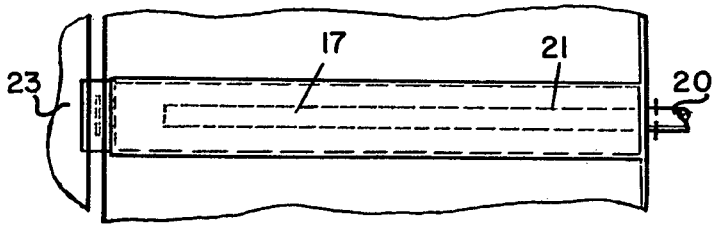
FIG. 4
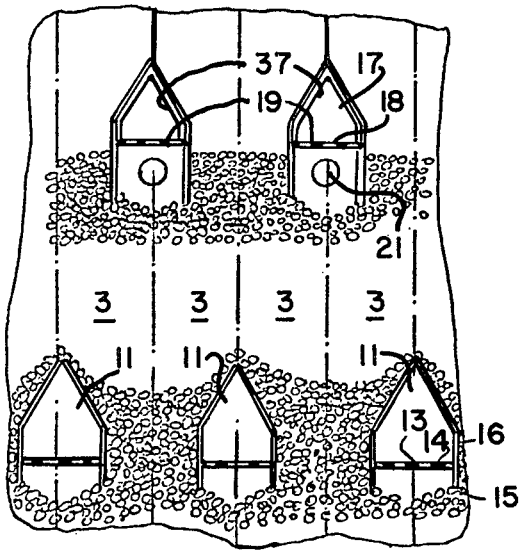
FIG. 5

APPARATUS FOR PRODUCING ABRASION RESISTANT COKE FROM BROWN COAL BRIQUETS

This is a division of application Ser. No. 018,870 filed Mar. 9, 1979.

BACKGROUND OF THE INVENTION

1. Field of the Invention

This invention relates in general to coking devices and in particular to a new and useful method and apparatus for producing abrasion resistant coke.

2. Description of the Prior Art

A method for producing abrasion proof coke forms from coal briquets is known from German Offenlegungsshrift No. 2 507 735. According to a variant of the method disclosed in German Offenlegungsschrift No. 2 537 191, steam may be added into the circulating hot gases of the preheating and drying stages. These methods have proved satisfactory in practice and abrasion proof coke forms which are poor in sulfur and ash are obtained in accordance therewith. There has been a problem, however, that the preheating and drying circulation gases escaping from the briquet charges of the preheating and drying stages are saturated with steam to an extent such that their temperatures are near the dew point so that upon a small drop of the temperature, aqueous condensates precipitate, primarily on the apparatus walls, which form smudgy to solid deposits together with the coal dust also contained in the gases and diminish the cross-sectional areas of the apparatus and pipes. This causes failures in operation with the necessity of stopping the plant for cleaning.

SUMMARY OF THE INVENTION

The invention is directed to a new method for producing the coke forms by which the disturbances of the prior art are eliminated.

In accordance with a method of the invention for producing abrasion resistant coke from brown coal briquets, coal briquets are directed into the top of a shaft furnace which comprises a bottom section for the removal of the finished coke product. The shaft furnace is divided throughout its height into a plurality of individual stages which includes means for directing inert combustion gases into the various stages which are at temperatures to effect in successively lower stages in the furnace the preheating, predrying, carbonizing and cooling the charge. The gases which are circulated through the briquets are collected in both the preheating and predrying stages in amounts such that temperatures of gases which are collected from each stage exceed steam saturation temperature by at least 20° C. The collected gases are remixed with the circulating gases and the gases which are withdrawn from each stage are continuously cleaned and recirculated.

In accordance with the invention, the circulating gases are heated at the suction side to raise their temperatures farther from their steam dew points and to avoid condensation in apparatus and pipings and solid deposits which might cause the above-mentioned troubles.

In addition, to prevent coal dust from settling on the briquet charges of the preheating and drying stages and hindering the free passage of the gases, it is provided, in accordance with the invention, that the gases drawn off the briquet charge pass into the free space immediately above the briquet charge at a speed of 1.5 to 6.0 m per second and pass into the free space immediately above the briquet charge where their speed drops to 0.5 to 2.0 m per second, whereupon the larger part thereof is drawn off at a speed of 10 to 15 m per second through apertures of perforated bottoms or similar structures located above the free space of horizontal suction arms which are intended for a sideward evacuation of the gases and discharged therefrom, and the remaining smaller part of the gases is drawn out of the free space between the briquet charge and the perforated bottom sidewards, below the perforated bottom, through a lock opening and also at a speed of 10 to 15 m per second, and discharged. Due to this splitting of the gas stream, a motion component in the direction of the discharge lock opening is imparted below the perforated bottom to the raised and turbulent coarser dust particles which form a fluidized layer above the briquet charge. A substantial part of the dust can thus directly be drawn off into a main line. This also prevents the coarser dust components from accumulating below the perforated bottom and causing disturbances in operation.

Experience has shown that it is advantageous to remove 70 to 90% of the gases through the suction arms and 30 to 10% below the perforated bottoms.

In the method according to German Offenlegungsshrift No. 2 537 191 also, a hot inert gas, namely steam, is added in the preheating and drying stages. This, however, is done for a different purpose, namely to maintain certain partial steam pressures relative to the briquets to be preheated and dried, and also at another location, namely in advance of feeding into the stage inlet.

Accordingly it is an object of the invention to provide a device for producing abrasion resistant coke from brown coal briquets which comprises a shaft furnace with means for charging coke briquets into the top of the shaft furnace and for removing coke from the bottom thereof, wherein the shaft furnace is divided vertically into a plurality of stages from the top to the bottom, including at least one preheating stage, one predrying stage, one carbonization stage, below the preheating and predrying stages, and one cooling stage below the carbonization stage, wherein each predrying and preheating stage has at least one inert hot gas inlet for circulating hot inert gases therethrough, and at least one gas withdrawal means including a closed tubular gas suction arm extending across the furnace having a perforated bottom wall with guiding walls on each side thereof so that gases are circulated from the stage upwardly around the guiding walls and through the bottom wall so that at least 10% of the gases are withdrawn in this manner so as to inhibit the flowing of dust along with the gases, and wherein means are provided for directing the withdrawn gases back into the circulated gas stream.

A further object of the invention is to provide a method of producing abrasion resistant coke from brown coal briquets in a shaft furnace which comprises charging the coke briquets into the top of the furnace and removing the coke from the bottom of the furnace, directing inert hot combustion gases into the furnace and through the briquets at a plurality of levels throughout the height of the furnace and at temperatures to effect in successively lower stages in the furnace preheating, predrying, carbonizing and cooling of the charge, selecting gases which are circulated through the briquets in both the preheating and predrying stages and in amounts such that the temperatures of the gases which are collected from each stage exceed the steam saturation temperatures by at least 20° C., and mixing them with the inert hot combustion gases and continuously drawing off, cleaning and recirculating gases from each stage.

A further object of the invention is to provide a device for producing abrasion resistant coke which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 2 is an enlarged detail of FIG. 1 showing the design of the preheating and drying stages;

FIG. 3 is a sectional view taken along the line A—A of FIG. 2;

FIG. 4 is a sectional view taken along the line C—C of FIG. 2; and

FIG. 5 is a sectional view taken along the line B—B of FIG. 2.

GENERAL DESCRIPTION OF THE PREFERRED EMBODIMENTS

Figure 1:
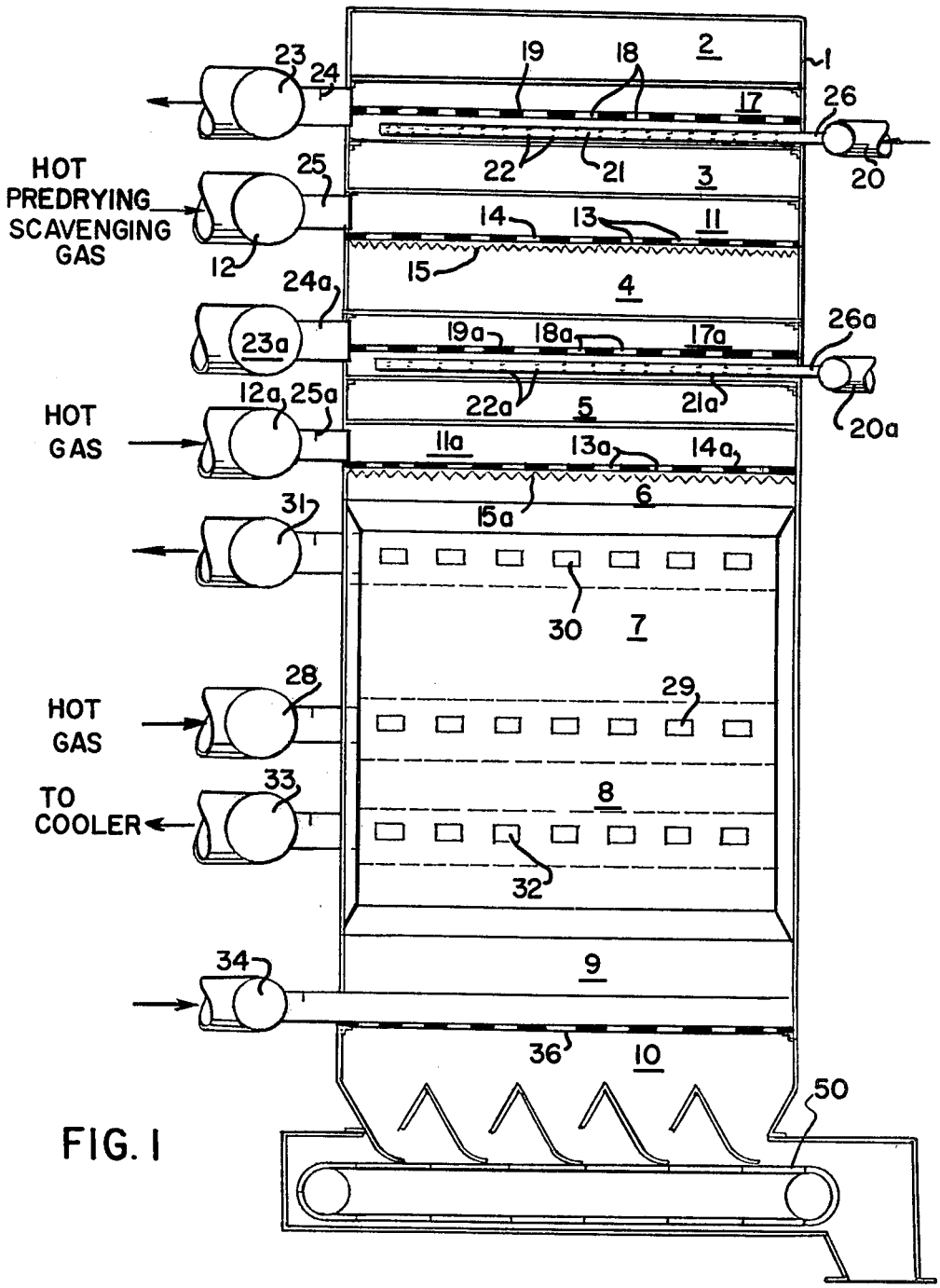
FIG. 1 is a diagrammatical longitudinal sectional view of a shaft furnace comprising the installations for the individual operating steps.

Referring to the drawings in particular, the invention embodied therein comprises a method of producing abrasion resistant coke from brown coal briquets in a shaft furnace 1 which comprises charging the coal through charging means at the top of the furnace and removing coke from the bottom by a coke discharge device 10 connected to a conveyor 50. Inert hot combustion gases are directed into the furnace through tubular conduits 12 and 12*a* into respective preheating and predrying sections or stages and through a conduit 28 in a carbonization zone. Gases are also withdrawn in the stages, such as through a gas outlet 23 in the predrying stage, 23*a* in the drying stage, conduit 31 and 33 in the carbonization stage. Gases which are directed into the furnace are inert combustion gases, and there are temperatures to affect and successively lower stages in the furnace the preheating, predrying, carbonization and cooling of the charge. The gases which are recirculated are collected by tubular gas suction members or arms which extend across the furnace and perforated bottom walls 19 through which at least 10% of the gases are withdrawn for recirculation. The gases which are withdrawn are cleaned by subjecting them to a separation process and recirculated with the hot inert gases into the various stages and at temperatures necessary for the process.

In FIG. 1, 1 is the body of the shaft furnace. A part 2 of the furnace 1 for charging the briquets to be carbonized is kept at a constant charging level with the aid of well-known automatic conveying means. A predrying zone 3 follows the part 2 and a cover gas zone 4 lies between the preheating zone 3 and a drying zone 5. 6 is a cover gas zone between the drying zone 5 and a coking zone 7, and 8 is a cover gas zone between the coking zone 7 and the cooling zone 9. A discharge space 10 at the bottom is provided for the finished and cooled coke briquets, and it comprises discharge pockets and conveying accessories. The hot predrying scavenging gas having a temperature of about 100° to 130° C. is introduced into an inlet duct 11 through a line 12. It passes through openings 13 in a bottom sheet 14 of inlet duct 11 (see FIG. 5) into the briquet charge of the predrying zone 3.

To facilitate the gas passage into the briquet charge, a side sheet 16 (FIG. 5) of inlet duct 11 is provided with saw-teeth-like lower edges 15. After the preheating gas has passed through the briquet charge of the preheating zone, its temperature is lowered to about 80° to 100° C. and it passes through openings 18 in bottom sheet 19 into a gas suction arm 17. The inside surfaces of suction arm 17 are provided with a thermal insulation 37 (FIG. 5). To prevent condensation, hot gas having a temperature of 500° C. is blown into suction arm 17 through a pipe 20 and stub pipe 21 (FIG. 4) having apertures 22 (FIGS. 2 and 5) uniformly distributed over the pipe length, i.e. into the free duct-like space formed by the side walls of the suction arm 17 which are extended about 20 cm downwardly below perforated bottom 19, the perforated bottom 19 itself, and the slopes 17*a* of the briquet charge. The mixture of hot gases and cooled preheating gases is drawn off through a gas outlet 23. To uniformly load all inlets and outlets, calibrations or sized orifices 24, 25 and 26 are provided. An opening 27 is provided in gas outlet 23 to ensure that a gas flow in the direction of the gas outlet 23 forms below the bottom sheet 19, in accordance with the invention. The ratio of the cross-sectional area of opening 27 to the total cross-sectional area of all apertures 18 in bottom 19 is about 1 to 10, i.e. about 10% of the gases are evacuated sidewards below perforated bottom 19. The effect of this flow component is that the dust is entrained toward gas outlet 23 and does not deposit on the briquet charge and that the hot gas becomes uniformly distributed in the space below gas suction arm 17. The design of the drying stage 5 is identical with that of preheating stage 3. Therefor, similar identical reference numerals but with an "a" following, are employed to identify the individual elements. The drying gas amount passing through the drying zone, however is about 2½ times larger than the gas quantity used in the preheating stage.

The carbonization zone 7 following the cover zone 6 may be of any design. For example, it may be designed for indirect heating with heating walls and heating flues.

FIG. 1 shows zone 7 in a design for direct heating by hot gases, admitted through a supply line 28 for the hot coking gas which passes to the briquet charge to be carbonized through openings 29. The gas is drawn off at the upper end of the carbonization zone, through openings 30 and lines 31. Together with the coke-oven gas of the coal briquets it forms a gas mixture having a minimum calorific value of about 1200 kcal/Nm$^3$. The produced coke is cooled by a cooling gas circuit in which the hot coke-oven gas is directed through openings 32 and a line 33 to a cooler (not shown) where it is cooled down to about 20° to 40° C. and recycled to the coke charge by means of a blower, pipes 34 and 35, and openings 36. The coke is discharged from the plant through discharge and shutoff mechanisms 10 provided in the cooling zone and conveyed away by a conveyor 50.

The material leaves the preheating zone with a temperature of about 85° to 95° C., the drying stage with about 150° to 200° C., the carbonizing stage with 900°

C. to 1100° C., and the cooling stage with 25° C. to 40° C.

From the gas suction arm 17 of preheating zone 3 the gases are drawn off at a speed of more than 2 m/sec and they have a temperature of 100° C. to 130° C. at a steam saturation temperature of 70° C. to 80° C.

From the gas suction arm 17*a* of drying zone 5 the gases are drawn off at a speed of more than 2 m/sec and they have a temperature of 150° C. to 220° C. at a steam saturation temperature of 80° C. to 95° C.

What is essential for carrying out the method is the arrangement of suction arms 17 in shaft furnace 1 and their design with the perforated bottom 19 having apertures 18 and with the side walls which extend about 20 cm downwards beyond bottom 19, as well as the provision of the stub pipe 21 with openings 22 for feeding hot gas into the space below perforated bottom 19 and between side walls.

Another substantial inventive feature is that the total cross-sectional area of all openings 18 of perforated bottom 19 is about 10 times larger than the cross-sectional area of opening 27 through which the gases below bottom 19 escape.

While specific embodiments of the invention have been shown and described in detail to illustrate the application of the principles of the invention, it will be understood that the invention may be embodied otherwise without departing from such principles.

What is claimed is:

1. In a device for producing abrasion resistant coke from brown coal briquettes of the type having a shaft furnace divided vertically in successive stages in which the brown coal briquettes are passed through preheating, drying, carbonizing and cooling stages, and respective hot gas inlets and outlets communicating with each of the preheating, drying and carbonizing stages, the improvement comprising at least one gas suction arm traversing said furnace at each of the preheating and drying stages operatively connected for fluid communication to the respective outlet thereof for drawing gas from said furnace, said gas suction arm having a tubular upper wall portion connected to a perforated bottom wall portion, side wall portions depending from said tubular upper wall portion at opposite sides of said bottom wall portion and extending below said bottom wall portion, and extending below said bottom wall portion, and means disposed below said bottom wall portion intermediate said side wall portions for passing the hot gas into said suction arm.

2. The improved device set forth in claim 1 wherein each of said respective outlets communicating with gas suction arm has a first outlet portion communicating with a space below the bottom wall portion and intermediate said side wall portions, and a second outlet portion communicating with a space above the bottom wall portion and intermediate the bottom wall portion and the tubular upper wall portion.

3. The improved device as set forth in claim 2 wherein said first outlet portion has a cross sectional area in communication with said space below the bottom wall portion, and said perforated bottom wall portion has a total perforated area about ten times said cross sectional area of said first outlet portion.

4. The improved device as set forth in claim 3 wherein said suction arm is sized such that 70 to 90% of the gas is drawn off through said second outlet portion and 30 to 10% is drawn off through said first outlet portion.

5. The improved device as set forth in claim 3 wherein said side wall portions include a bottom edge having a saw tooth configuration.

6. The improved device as set forth in claim 3 wherein said means disposed below said bottom wall portion intermediate said side wall portion for passing a hot gas into said suction arm comprises a perforated pipe.

* * * * *